US011479384B2

(12) United States Patent
Houghton

(10) Patent No.: US 11,479,384 B2
(45) Date of Patent: Oct. 25, 2022

(54) FOOD BOX CONTAINER AND METHOD

(71) Applicant: Adam R Houghton, Carson City, NV (US)

(72) Inventor: Adam R Houghton, Carson City, NV (US)

( * ) Notice: Subject to any disclaimer, the term of this patent is extended or adjusted under 35 U.S.C. 154(b) by 0 days.

(21) Appl. No.: 17/527,978

(22) Filed: Nov. 16, 2021

(65) Prior Publication Data

US 2022/0144482 A1 May 12, 2022

Related U.S. Application Data

(62) Division of application No. 16/984,126, filed on Aug. 3, 2020, now Pat. No. 11,174,066.

(60) Provisional application No. 62/882,468, filed on Aug. 2, 2019.

(51) Int. Cl.

| | |
|---|---|
| ***B65D 5/66*** | (2006.01) |
| ***B65D 5/48*** | (2006.01) |
| ***B65D 5/42*** | (2006.01) |
| ***B65D 5/20*** | (2006.01) |
| ***B65D 5/50*** | (2006.01) |
| *B31B 50/00* | (2017.01) |

(52) U.S. Cl.

CPC ..... *B65D 5/6626* (2013.01); *B65D 5/2028* (2013.01); *B65D 5/2057* (2013.01); *B65D 5/4266* (2013.01); *B65D 5/48002* (2013.01); *B65D 5/5021* (2013.01); *B65D 5/6658* (2013.01); *B31B 50/0044* (2017.08)

(58) Field of Classification Search

CPC ..... B65D 5/6626; B65D 5/48002; B65D 5/2057; B65D 5/5021; B65D 71/72; B65D 2571/00925; B65D 5/6652; B65D 5/208; A47G 23/06; A47G 23/0608; B31B 50/0044

USPC ..... 229/904, 120.08, 120.18, 120.03, 143, 229/126, 146, 152, 124; 206/562, 565, 206/216, 521.6; 493/162, 912

See application file for complete search history.

(56) References Cited

U.S. PATENT DOCUMENTS

| | | | | |
|---|---|---|---|---|
| 4,572,423 A * | 2/1986 | Spencer | ..... | B65D 5/0015 206/509 |
| 5,788,081 A * | 8/1998 | Bates | ..... | A47G 23/06 206/562 |
| 10,457,468 B2 * | 10/2019 | Michaels | ..... | B65D 81/386 |

(Continued)

*Primary Examiner* — Christopher R Demeree

(74) *Attorney, Agent, or Firm* — Long & Chybik; John D. Long, Esq.

(57) ABSTRACT

The invention is a food box container and a method for operating same, the food box container comprises an open top box body pivotally connected to double-hinged top, the open top box body further defining a hollow interior configured to receive and hold food; the double-hinged top has a first hinge and second hinge that have a spaced-apart and parallel orientation to one another, the first hinge pivotally sections the double-hinged lid into a support panel and a top lid, the second hinge pivotally connects the support panel to the open top box body; the support panel further defines one or more removable caps which when opened from the support panel reveal support apertures to receive other containers of drinks, condiments and the like; and the top lid controls a second access to the hollow interior that is smaller than an access as provided by the double-hinged top.

11 Claims, 7 Drawing Sheets

(56) References Cited

U.S. PATENT DOCUMENTS

| | | | | |
|---|---|---|---|---|
| 10,730,657 | B1 * | 8/2020 | Spencer | B65D 5/2057 |
| 2019/0144180 | A1 * | 5/2019 | Mertz, II | B65D 71/0022<br>229/117.16 |

* cited by examiner

FOOD BOX CONTAINER AND METHOD

CROSS-REFERENCES TO RELATED APPLICATIONS

The Applicant claims priority to and incorporates same by reference the U.S. Non-provisional patent application Ser. No. 16/984,126 as filed on Aug. 3, 2020 and the U.S. Provisional patent application Ser. No. 62/882,468 as filed on Aug. 2, 2019.

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to food box containers used to hold fast food and other edible consumables, more particularity to those food box containers that are further configured to form apertures that can be used to accommodate and support other containers for condiments, drinks and alike that may be consumed with the fast food and other edible consumables.

BACKGROUND

Takeout pre-prepared food, often referred to as "fast food" in the United States, is often purchased, transported and eaten out of box-like takeout food containers. One possible venue that utilizes such takeout food containers could be sports arenas (e.g., baseball parks, football stadiums and the like) wherein concessions that the arenas sell food in such containers to allow sports arena patrons to transport the purchased food back to their places in the arena. One such food container could have a body with an exterior denoting a hollow interior for receiving and holding items, the body may be further distinguished as an open top box container body that hingedly connects to a top lid that substantially controls access between the hollow interior and environment external to the container. The container's hollow interior could be configured to substantially receive, hold and encapsulate one or more foods or consumables, condiment contains and the like removably placed in the food container. Sometimes the box container may be further configured to compartmentalize the container body into one or more open topped wells within the hollow interior into which one or more food condiments (e.g., like catsup, BBQ sauce, melted cheese and the like) may be placed. Such container boxes may be made from paper, cardboard, plastic, polystyrene foam and the like.

One possible issue with such food box containers may be that such food box containers generally not configured to directly address the holding or carrying of other container types such as drink containers (e.g., disposal beer or soda cups), condiment containers and the like. A (fast) food purchaser (e.g., such as a sports arena patron buying food at the arena food, drink concessions) may order pizza slice(s), chili-cheese dogs or other such food items that are placed in containers that onto which the purchaser holds. A food transportation issue may arise when the food purchaser has ordered several such food items at one (e.g., for friends and family sitting next to the purchaser at the sports arena) as well as other differently packed food items (drinks, bagged food such as chips, condiments and the like.) The food purchaser may struggle with carrying several food containers, drink containers, condiment containers and the like when taking the respective food purchases back to the purchaser's seat. Such difficulty may result in the purchaser spilling food items (e.g., upon the purchaser, on others or onto the floor) before arriving at or at the purchaser's arena seat. Another food handling issue may occur when the purchaser then arrives and sits down at the purchaser's respective arena seat to consume the purchased food. Fast food items, such as chili cheese nachos and chilidogs, are generally notorious for being a messy food stuff. Many times, the food container may be precariously perched upon the purchaser's lap, knee or alike. Such an awkward container placement could be significantly disrupted by a movement by the purchaser or others at the arena to cause a sudden and totally unwanted upset or dislodgement of the container, container food contents or both upon the clothing, shoes and the like of the purchaser or others seated nearby. In such conditions, the container, container food contents or both may also end up spilled upon the arena seating floor.

One possible solution to these issues could be the present invention, a food box container substantially having an open-top box body pivotally connected to a closable double hinged top. The double-hinged top generally controls outside access to the food box container's hollow interior as well as provides one or more uncoverable apertures for supporting and removably holding other containers of drinks, condiments, and the like. The double-hinged top may also provide a secondary hinged top lid to allow smaller secondary access to the hollow interior. In at least one embodiment, the food box container may have two adjacent container sides angled relative to one another in a manner (e.g., the food box container having a triangular, diamond or suitable shape) to allow an end-user (e.g., food purchaser, customer, consumer or the like) to grasp the said adjacent box sides between the end-user's thighs to removably, yet securely, hold the food box container while seated.

SUMMARY OF ONE EMBODIMENT OF THE INVENTION

Advantages of One or More Embodiments of the Present Invention

The various embodiments of the present invention may, but do not necessarily, achieve one or more of the following advantages:

- to provide a lidded food container in addition to hold food stuffs within the container's hollow interior could removably support other containers for drink, condiment and like through apertures formed on the food container lid;
- the ability to removably secure on a lid of food container by removing a cap to substantially expose a clawed aperture container that removable engages another food container such as drink or condiment container;
- to provide a box-type food container, a portion of which has a wedge-shape configured to be grasped and be removably held by the thighs of the operator while seated to provide an eating platform for the food that is carried by the box-type food container;
- the ability to removably hold a food stuff within an interior of a lidded food container while simultaneously removably holding a drink, condiment or like container in the lid-formed aperture and condiment container in container bottom-formed aperture;

to provide a box-type food takeout container whose hinged container top forms a punchout cover aperture that can removable receiving another container that can hold drinks, condiments or the like; and the ability to grasp the adjacent sides of the lidded food container between a user's thighs to removable and securely hold the food container in place while seated;

to provide a box-type food takeout container having to adjacent container sides

These and other advantages may be realized by reference to the remaining portions of the specification, claims, and abstract.

Brief Description of One Embodiment of the Present Invention

One possible embodiment of the invention could be a food box container comprising an open top box body pivotally connected to double-hinged top that removable seals a hollow interior configured to receive and hold food; the double-hinged top has a first hinge and second hinge that have a spaced-apart and parallel orientation to one another, the second hinge pivotally sections the double-hinged lid into a support panel and a top lid, the first hinge pivotally connects the support panel to the open top box body; the support panel is configured for supporting one or more other containers; wherein top lid pivots open from the open top box body to defines a first access to the hollow interior while alternatively, the double-hinged top pivots open from the open top box body to define a second and larger access to the hollow interior.

One possible embodiment of the invention could be a method or process of operation for a food box container box comprising providing a food box container comprising an open top box body pivotally connected to double-hinged top that removable seals a hollow interior; the double-hinged top has one hinge that pivotally sections the double-hinged lid into a support panel that defines one or more removable caps and a top lid, and another hinge that pivotally connects the support panel to the open top box body; inserting food into the hollow interior by operating the double-hinged top; opening one or more removable caps and revealing one or more support apertures to removably receive one or more other containers; and accessing the hollow interior by using the top lid with the support panel staying closed upon the open top box body.

The above description sets forth, rather broadly, a summary of one embodiment of the present invention so that the detailed description that follows may be better understood and contributions of the present invention to the art may be better appreciated. Some of the embodiments of the present invention may not include all the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized, and structural changes may be made without departing from the scope of the present invention.

Figure 1:
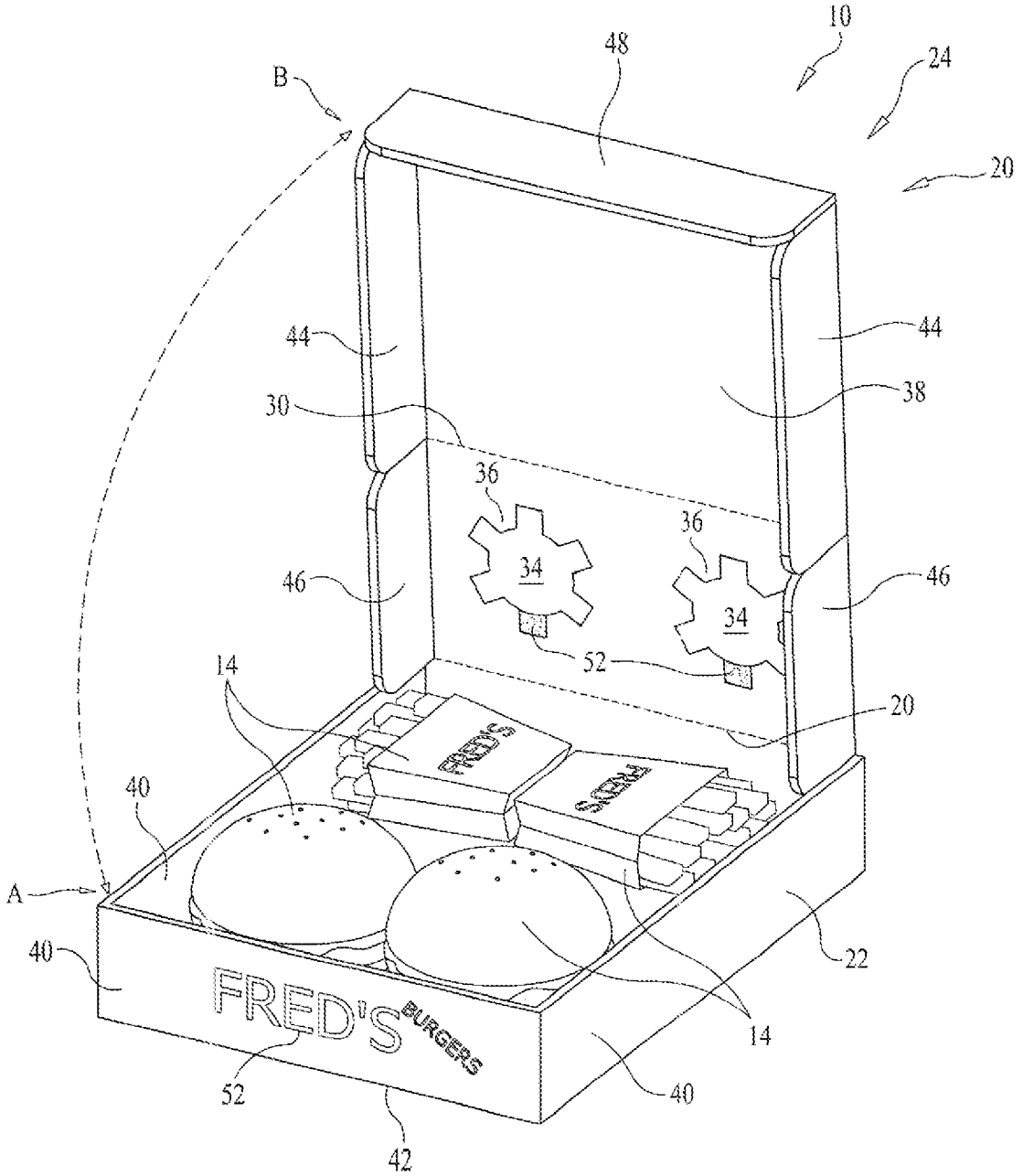
FIG. 1 is substantially a perspective view of one embodiment of the rectangular-shaped version of the present invention with the double-hinged top in the open position.
Figure 2:
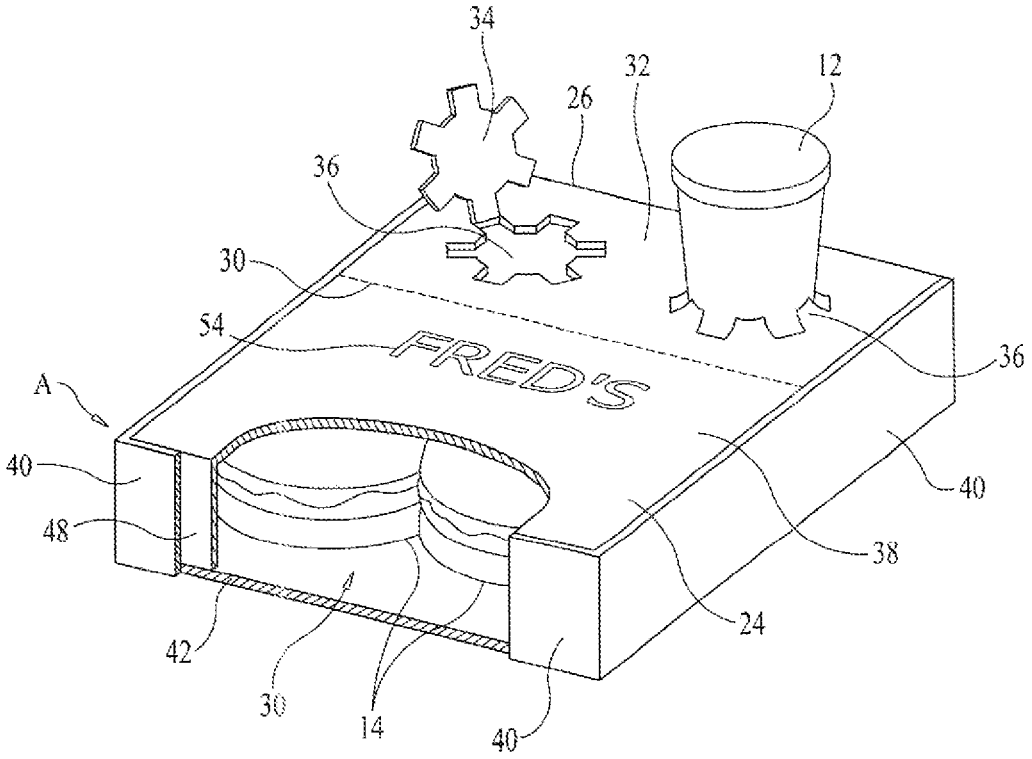
FIG. 2 is substantially a cutaway view of one embodiment of the rectangular-shaped version of the present invention with the double-hinged lid in the closed position.
Figure 3:
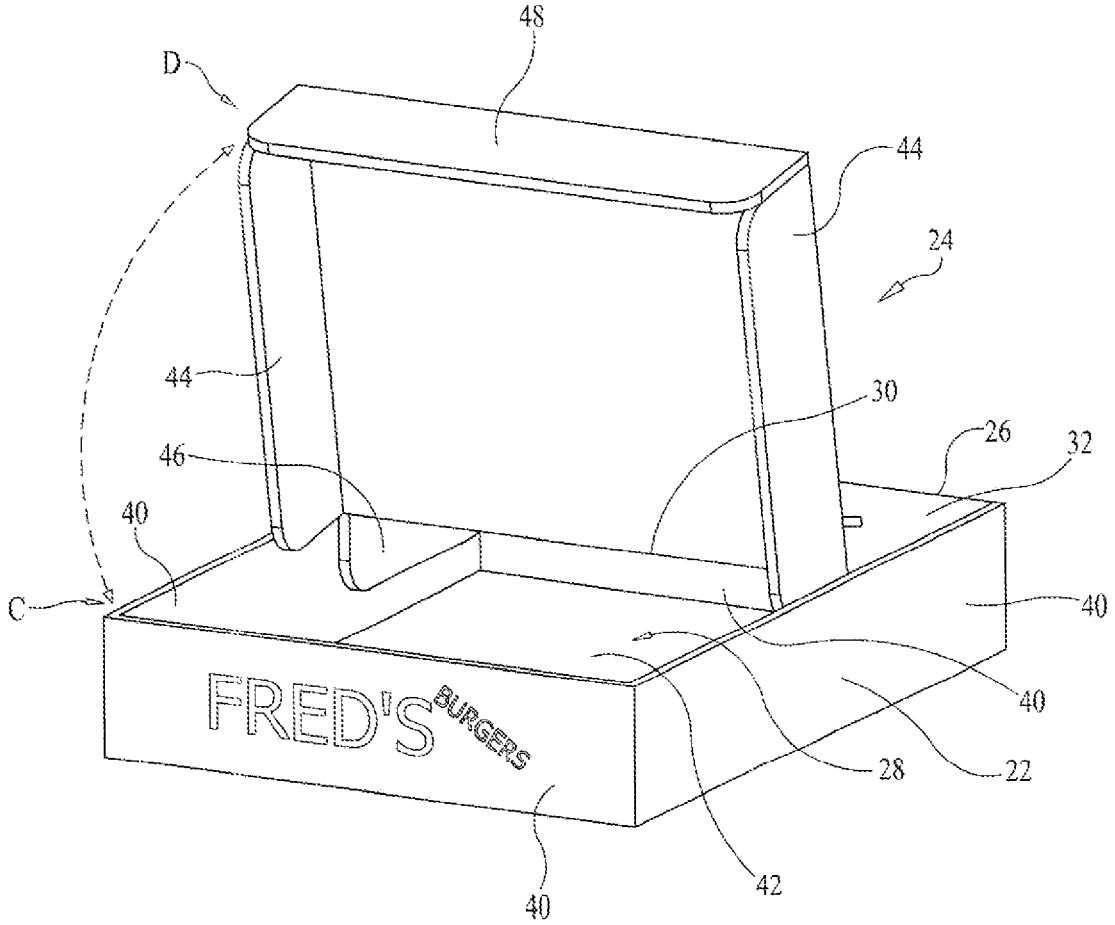
FIG. 3 is substantially a perspective view of one embodiment of the rectangular-shaped version of the present invention with the top lid in the open position.
Figure 6:
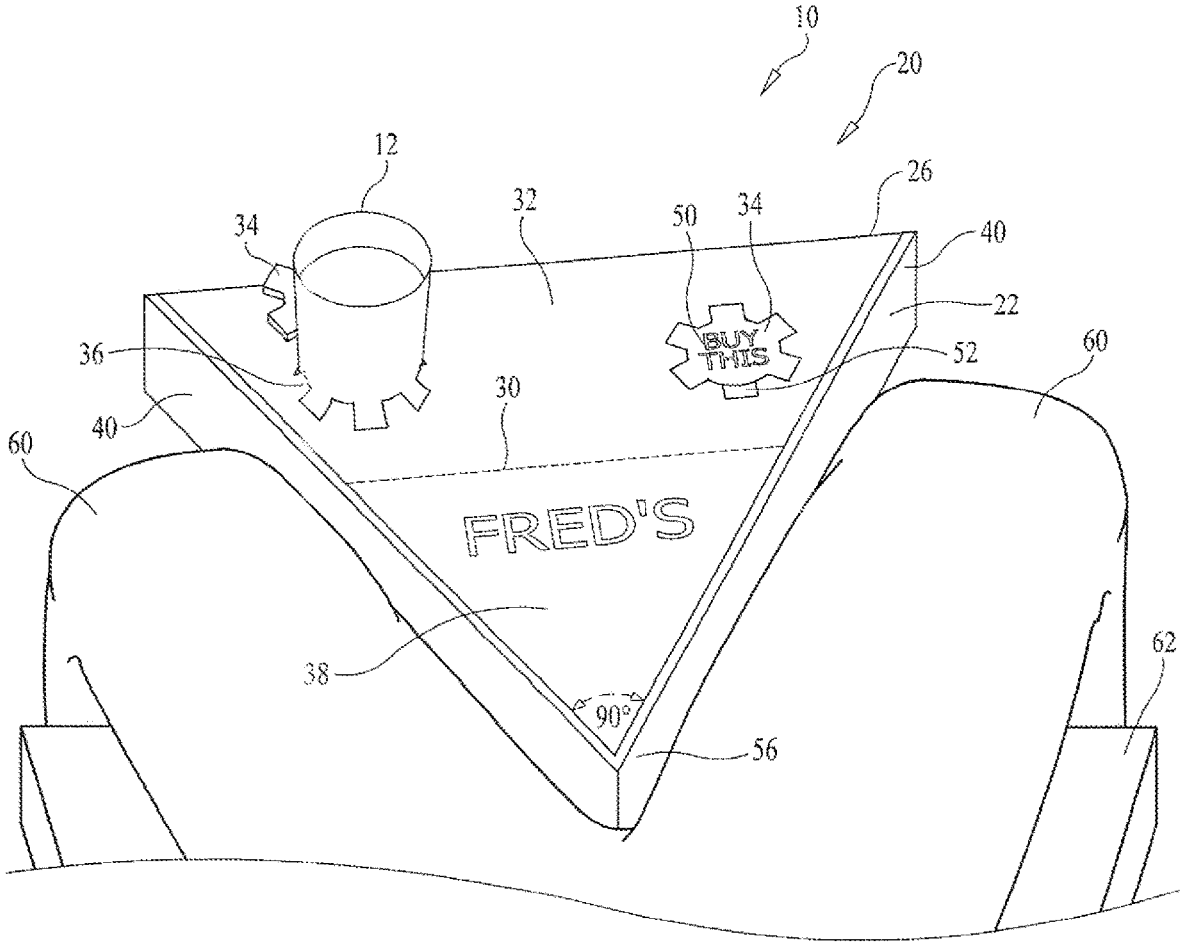
FIG. 6 is substantially a perspective view of one embodiment of the triangular-shaped version of the present invention with the double-hinged top in the closed position as the present invention is held between pair of thighs.
Figure 7:
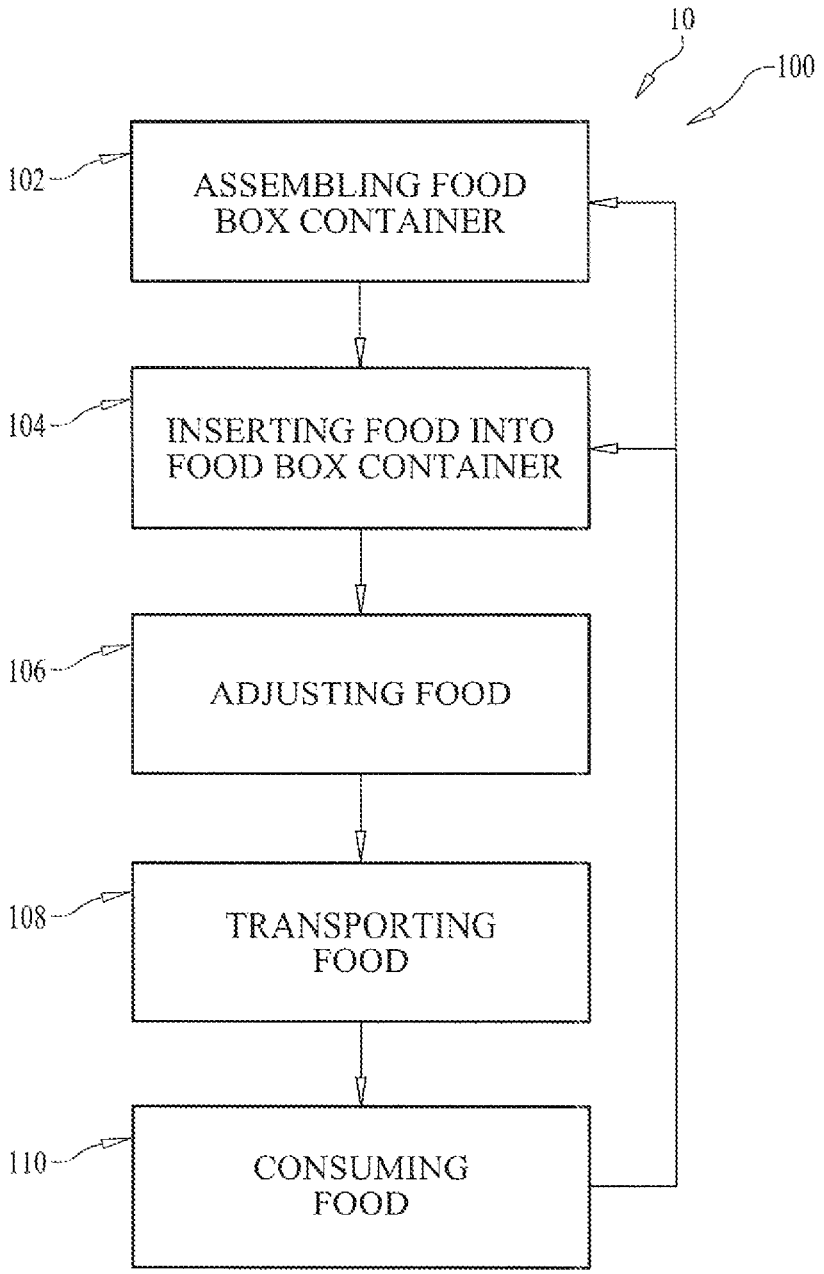
FIG. 7 is substantially a schematic flow chart of one version of operating the present invention.

The present invention 10 could comprise a food box container 20 (as substantially shown in FIGS. 1-6) and a method 100 of using same (as substantially shown in FIG. 7). As substantially shown in FIGS. 1-3, one possible embodiment of a food box container 20 could comprise an open-top box body 22 pivotally connected to a closable double-hinged top 24. In one embodiment, the food box container 20 may have a rectangular or square shape. Four continuously connected sides 40 connected perpendicularly to the respective edges of a bottom sheet 42 could generally form the open top box body 22.

A first hinge or fold 26 could pivotally connect the double-hinged top 24 to the open-top box body 22, allowing the double-hinged top 24 to substantially move between a first or closed hinged lid position A and a second or open hinged lid position B. In position A, the food container's hollow interior is substantially removably sealed to open-top box body 22. The second or open hinged lid position B generally allows access from outside of the food box container 20 to the food container's hollow interior 28 (e.g., where food 14 may be removable placed and supported.)

The double-hinged top 24 could further feature a second hinge or fold 30 running parallel and spaced apart from the double hinged top's first hinge 26. A space between the two hinges or folds 26, 30 could further define a support panel 32 for removably holding and supporting other containers 12 (such cups, bottles and cans) for holding drinks, condiments and the like. The support panel 32 may be substantially delineate through coordinated cuts, perforations or both one or more removable caps 34. When such a cap 34 is opened or totally removed from the support panel 32, the opening or removal exposes a respective clawed support aperture 34 that could removably receive and support a respective other container 12 (e.g., a container for removably receiving and supporting drinks, condiments, melted cheese and the like.) The claws of said aperture 34 could be protrusions into the defined aperture space that could have fiction-fit relationship with the side of the other container 12 when placed into the clawed support aperture for carrying. Such a friction fit interaction could help hold the removably retained other container 12 from being jostled or otherwise being unwantingly displaced from the invention 10 during use. The removable cap 34 could be further made to define a finger cutout 52 that can be accessed by a finger (not shown) of the concessionaire or others to help take out the removable cap 34 from the remainder of the support panel 32 to expose the respective clawed support aperture 36.

In one embodiment, the removable caps 34 could display indicia of offers 50 to be redeemed, the indicia 50 further indicating how, where or both to redeem such offers (e.g., reduction in price in for sponsor's goods, services or both.) The sponsor could pay the party that is supplying the invention 10 to the concessionaire or sporting arena for placement of these redemption offers upon the removable caps 34. Similarly, other third-party advertising indicia could be placed elsewhere on the food container's double-hinge top 24, sides 40 or both.

The second hinge 30 could further provide apportionment of the double-hinged top 24 into a support panel 32 and a top lid 38. When the support panel 32 is being held closed upon the open-top box body 22 to support one or more other containers 12, the top lid 38 could move or pivot between a first or closed top lid position C that is closed upon the open-top box body 22 preventing outside access to the hollow interior 28 to a second or open top lid open position D that generally permits outside access to the hollow interior 28. It should be noted that if no other containers 12 for drinks, condiments or alike are being removably supported by the support panel then the entire double-hinged top 24 (i.e., the support panel 32 and the top lid 38 together) could pivoted to control outside access to the hollow interior 28.

The side edges of both top lid 38 and the support panel 32 could generally perpendicularly mount their own respect set of flaps, top lid flaps 44 and support panel flaps 46 whose respective friction fit interaction with the sides 28 could help retain the support panel and the top lid in the first or closed $1^{st}$ hinge/$2^{nd}$ hinge closed positions A, C while generally carrying food 14 within the hollow interior 28. The top lid 38 additionally could have an end flap 48 attached the edge of the top lid end that is opposed to the top lid end attached to the second hinge 30. This top lid end flap friction fit interaction with the sides 28 to help also retain the top lid 38 when placed in the first or closed top lid position C.

Figure 4:
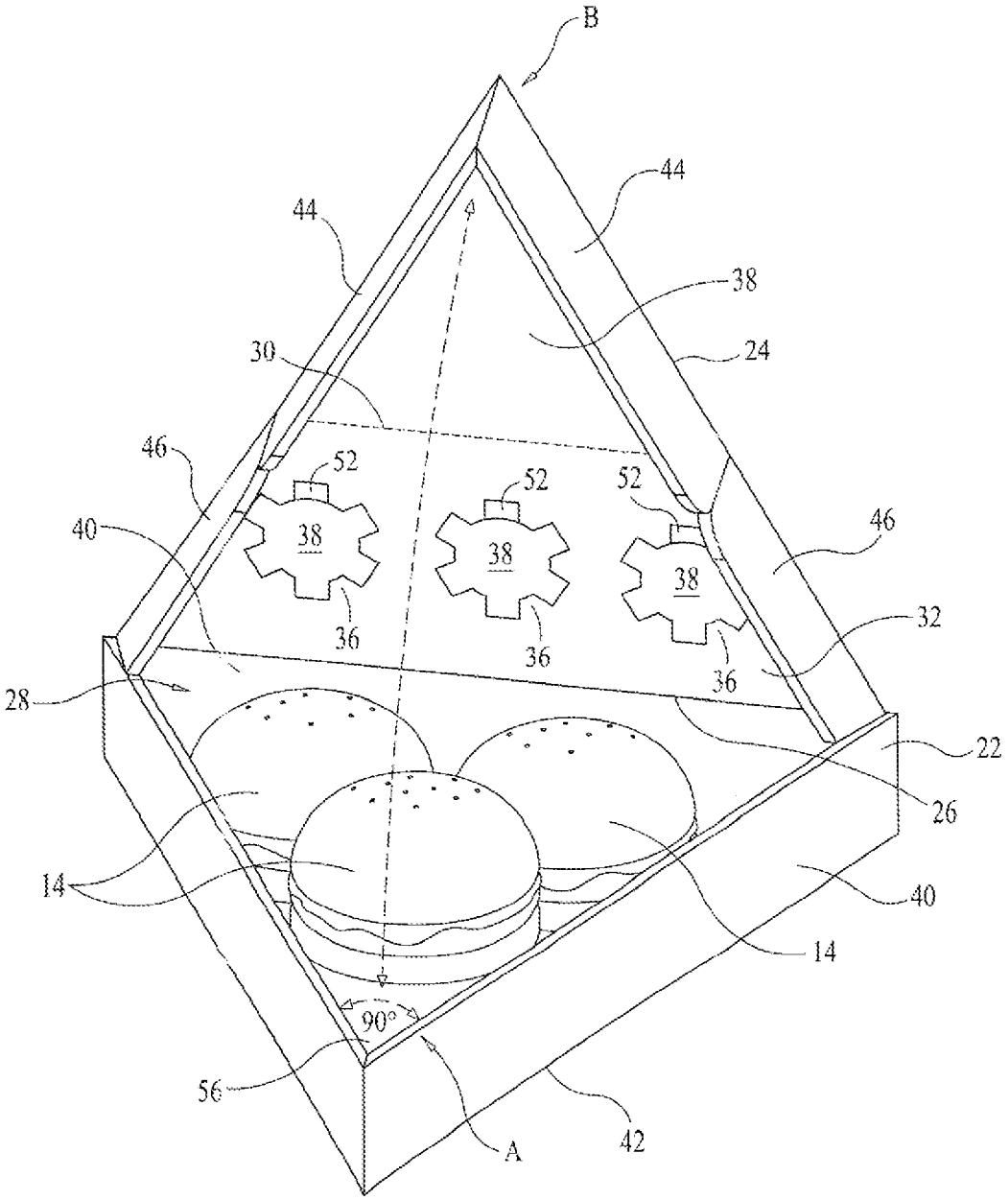
FIG. 4 is substantially a perspective view of one embodiment of the triangular-shaped version of the present invention with the double-hinged top in the open position.
Figure 5:
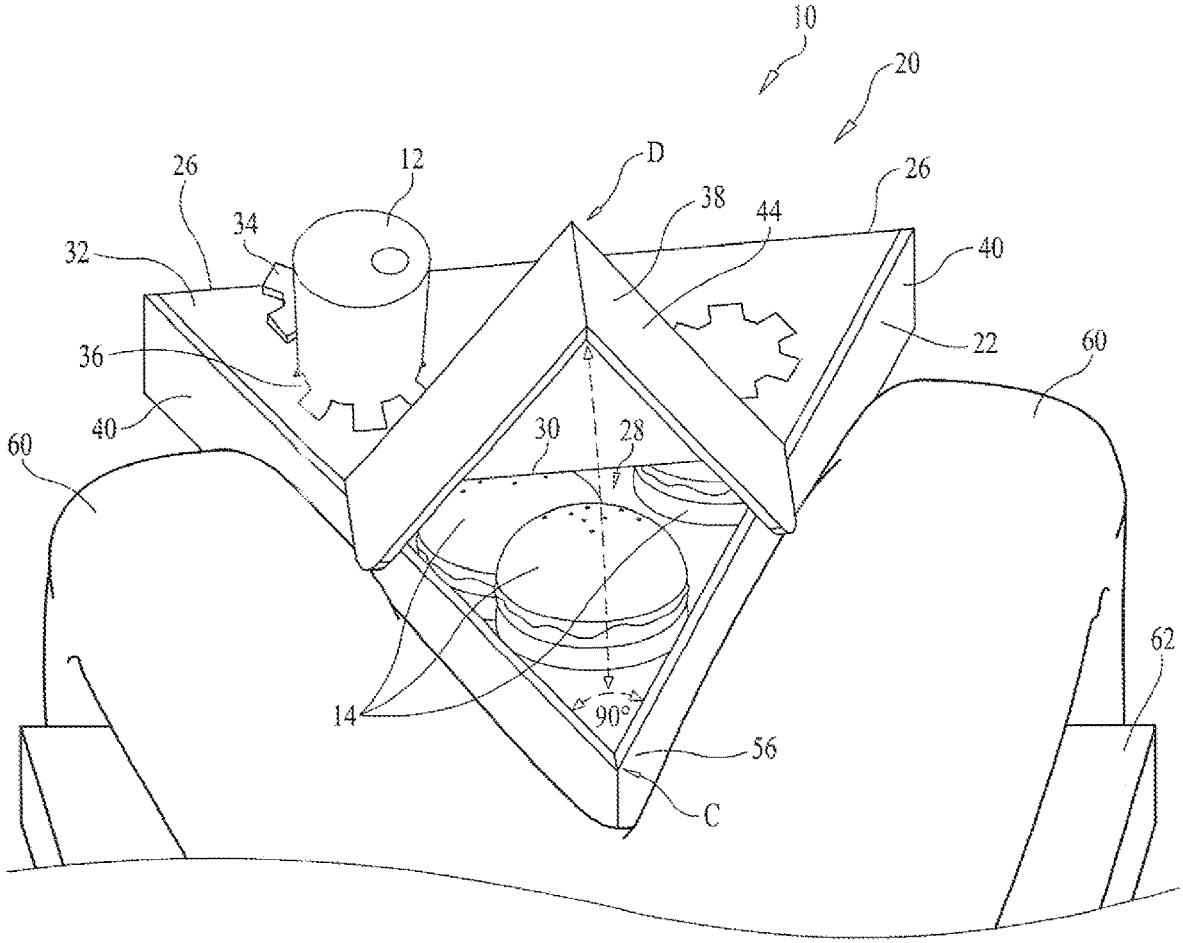
FIG. 5 is substantially a perspective view of one embodiment of the triangular-shaped version of the present invention with the top lid in the open position as the present invention is held between pair of thighs.

As substantially shown in FIGS. 4, 5, and 6, another embodiment of the present invention 10 could be a food box container 20 generally having a shape (e.g., a triangle, diamond or other suitable shape) that allows two sides 40 (e.g., adjacent sides) of the food box container 20 to be angled relative to one another to allow the respective sides to be removably, yet securely, grasped by the end-user's inner thighs 60. The two sides 40 in this manner could have an acute angle 56 relationship between each other. It so thought that utilizing an angle greater than an acute angle between the two sides 40 would make the food box container 20 too wide and uncomfortable for the end user to grasp with the ended user's thighs 60. In at least one version, the two acute angled adjacent sides 40 could also be adjacent to one another to form an acute angle 56 and an apex.

As substantially shown in FIG. 5, when the invention is so grasped by the end-user the apex could be placed proximate to the end user's groin. When so positioned, a portion of the bottom sheet 42 may be further be supported by a portion of the seat 62, not shown, (e.g., area seat) that the end-user is seated in. The placement of the food box container 20 in this manner may make the food box container 20 less susceptible to dislodgement when consuming the foods stuffs carried by the invention 10 in a congested and otherwise crowded environment.

Other containers 12 (e.g., used for removably carrying condiments drinks, melted cheese and the like) as used with the invention 10, may be generally cylindrical cans or bottles to being inverted, conically shaped cups with enclosed narrow flat bottoms and open wide tops that connect a hollow interior for receiving liquids to an exterior. The top of the conical-shaped cup may further have a top rim curled lip that may snuggly engage a cap that is removably affixed to the cup top to help limit drink spillage. Similarly, the other containers 12 may be smaller sized inverted conical-shaped cups with enclosed bottoms and open tops that connect a hollow interior for receiving liquids and the like to an exterior. The other containers 12 could also further feature a curved rim at running alongside the top edge of the condiment container opening to removably engage a cap to limit spillage. Depending on the construction of the clawed support apertures 36, the respective curved rim could rest on the top surface of the support plate 32 rather than having the conical-shaped cup's slated sides removably engage the claws as formed by the clawed support aperture 36.

In at least one embodiment (not shown), the food box container 20 could be formed from a single precut and pre-folded sheet of cardboard, such as smooth-sided corrugated cardboard. In such a construction, a plurality of folds of the single precut and pre-folded sheet of cardboard could further be used to define edges of the double-hinged top. Two of these folds could be in an acute angle relationship to one another such that if the two folds were continuous to each other they would form an acute angle. This folds orientation and resulting assembled double-hinged lid could allow the food box container to be configured to be removably received and held by an end-user's inner thighs when in a seated position.

As substantially shown in FIG. 7, one possible embodiment of the method or process 100 for using the invention 10 could start with step 100 assembling the food box container. A set or pallet of unassembled food containers comprising precut and pre-creased flat sheets of corrugated cardboard can be accessed by concessionaire (not shown). The concessionaire could the fold, press and otherwise manipulated the individual corrugated cardboard sheets into forming the food box containers. The assemble food box containers could then be stacked or otherwise stored in the concessions area where food preparation takes place to pre-stage the invention for food sales and to be able to fill consumers orders in a timely fashion. As this step is substantially completed, the process 100 proceed to step 104, filling the containers.

In step 104, filling the containers, when food sale is made, the concessioner may obtain the assembled food box container and then open the double-hinged top (e.g., either open the full or partial double hinged top) for the insertion of the customer-ordered foods (e.g., hamburgers, fires, onion rings and the like) into the respective hollow interior. The double-hinged top then may be shut (e.g., placed into the first or closed double hinged top position by pivoting about the first hinge) with the respective flaps being placed into the hollow interior to have fictional contact with the inner sides of the open top box body to help hold the double-hinged top closed. As the needed to accommodate other containers arises, the removal caps can be pulled out (through finger insertion into the finger hole of respective removable cap) to expose the respective clawed support apertures. Other containers such as beverage bottles, cups, and cans; condiment cups filled with appropriate condiments requested by or filled by the food purchaser; hot cheese containers and the like other containers can be suitably inserted into clawed support apertures. The loaded-food box container made then be given to the end user (e.g., food purchaser, consumer, customer, etc.) upon payment by the end user for the ordered food. Upon substantial completion of this step, the process 200 could proceed to the next step 106, accessing the hollow interior.

In step 106, accessing the hollow interior, if the end user wishes to place seasoning, condiments, dressings, hot cheese, or the like directly upon food stuffs held in the hollow interior, the top lid can be grasped and pivoted upward about the second hinge interior from a first or closed top lid position to a second or open top lid position. By establishing outside access to the hollow interior in this manner, the food stuffs can be suitably seasoned and alike to the end user's taste with moving the support plate or any other containers removably held by the support plate. After the foodstuffs are set to end user's desire, the top lid can be rotated back to the first or closed top lid position with the respective flaps tucked in. Upon substantial completion of this step, the process 100 can proceed to step 108, transporting the food.

In step 108, transporting the food, the end user can gasp the loaded food box container(s) and transport them to a desired place of eating. In a sports, entertainment or alike arenas (not shown), this desired place of eating could be the end-user's arena seating. If the food box food container has angled adjacent sides that allow removable placement of respective angled adjacent sides between an inner thigh pair, the end-user can sit down on the end-user's seat and spread open the end-user's legs. The end-user can the carefully place the loaded food box container to locate the angled adjacent sides between the end-user's inner thighs (e.g., with the apex being held proximate to the end-user's groin). The end-user gently brings end-user's inner thighs together to removably grasp the angled adjacent sides to retain the load food box container between the end-user's legs. In this position, a portion of the bottom sheet should be supported by a front portion of the seat support as well. Drink containers at this time could be removed from the clawed support apertures and placed in seat cupholders as needed. As this step is substantially completed, the process 100 could proceed to step 110, consuming the food.

In step 110, consuming the food, the end user may then access the top lid and rotate the top lid away from the open top box body into the second or open top lid position to access the food inside the invention. For a version of the invention using angled adjacent sides, depending the placement of the angled adjacent sides (that may be removably held by the end-user's thighs) upon the food box container, the top lid may be rotated away from the end-user's torso. If the food as carried by the invention is not fully consumed at the arena, the remaining unconsumed food (e.g., food and drink) could be replaced as needed within the invention's hollow interior/clawed support apertures as appropriate. The top lid could be rotated closed generally sealing the food box container for transport. The angled adjacent sided version of the invention could have the end-user relax the end-user's thighs to release the end-user's grasp upon the food box container's angled adjacent sides. This action could allow removal by the end-user of the food box container from the invention's placement upon the end-user's seat and between the end-user's inner thighs. The end-user could then suitably transport the container with remaining food stuffs to the end user's home or alike as desired. If the foods are substantially consumed, then the food box container could be suitably disposed in a waste container. Once this step is substantially completed, then the process 100 could proceed back to step 102 or 104 as needed.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As shown and described above, the present invention provides for a lidded food box container that removably ensconces food within a hollow interior while providing other container support on the outside of the lidded food box container. In this manner, the invention makes for easier transport for a wide variety of food and drink especially of the type offered by concessions at sports, entertainment and other such arenas, as well as restaurants that provide for takeout food and the like. The invention may provide a more stable food and drink support platform by allowing the lidded food box container to be comfortably and removably grasped by the end-user's legs while seated.

What is claimed is:

1. A food box container comprising:

(A) an open top box body that pivotally connects to a double-hinged top, the open top box body further defines a hollow interior configured to removably receive and hold food;

(B) the open top box body further comprises a set of sides linked together and that further connect to a bottom sheet;

(C) the double-hinged top has a first hinge and second hinge that have a spaced-apart and parallel orientation to one another, the first hinge pivotally sections the double-hinged lid into a support panel and a top lid, the second hinge pivotally connects the support panel to the open top box body;

(D) the support panel is further configured to removably support one or more other containers;

wherein top lid pivots open from the open top box body to define a first access to the hollow interior while alternatively, the double-hinged top pivots open from the open top box body to define a second and larger access to the hollow interior that encompasses the first access to the hollow interior.

2. The food box container of claim 1 wherein the food box container is further formed from a single precut and pre-folded sheet of cardboard, a plurality of folds of the single precut and pre-folded sheet of cardboard further define edges of the double-hinged top, wherein two folds of the plurality of folds are in an acute angle relationship together to provide the food box container with a configuration that can be removably grasped by an end user's thighs when the end user is in a seated position.

3. The food box container of claim 2 wherein said two folds of the plurality are continuously connected to form an acute angle.

4. The food box container of claim 1 wherein two adjacent sides of the set of sides are in an acute angle relationship to one another to configure the food box container to be removably held by an end-user's thighs when the end-user is in the sitting position and to allow the double-hinged top to be opened by the end user.

5. The food box container of claim 4 wherein the said two adjacent sides of the set of sides are continuously connected to form an acute angle.

6. The food box container of claim 4 wherein the said two adjacent sides further form an apex that is placed proximate to the end user's groin when the food box container is removably grasped between the end-user's thighs.

7. The food box container of claim 4 wherein the box food container is configured to have a triangular shape, or alternatively, a diamond shape to allow the end-user to removably holding the box food container between the end-user's inner thighs while end-user is in a seated position.

8. The food box container of claim 1 wherein the support panel is configured to define at least one removable cap.

9. The food box container of claim 8 wherein the at least one removable cap further displays indicia informing of an offer to obtain goods, services or both from a merchant at a reduced price.

10. The food box container of claim 8 wherein an opening of the at least one removable cap from the support panel reveals a respective support aperture that is configured to removably receive and support another container for removably receiving and holding condiment, drink or food.

11. The food box container of claim 8 wherein the support panel further defines a finger cutout configured for opening of the one removable cap relative to the support panel.

* * * * *